United States Patent [19]

Jones

[11] Patent Number: 4,913,247

[45] Date of Patent: Apr. 3, 1990

[54] DRILL BIT HAVING IMPROVED CUTTER CONFIGURATION

[75] Inventor: Mark L. Jones, Midvale, Utah

[73] Assignee: Eastman Christensen Company, Salt Lake City, Utah

[21] Appl. No.: 204,683

[22] Filed: Jun. 9, 1988

[51] Int. Cl.[4] ..... E21B 10/46; E21B 10/48

[52] U.S. Cl. ..... 175/329; 51/307; 175/410

[58] Field of Search ..... 175/329, 330, 379, 421, 175/409, 410, 402, 403, 404; 51/307, 309; 29/400.1

[56] References Cited

U.S. PATENT DOCUMENTS

| | | | |
|---|---|---|---|
| 2,740,651 | 4/1956 | Ortloff | 175/329 X |
| 3,127,945 | 4/1964 | Bridwell et al. | 175/329 |
| 3,153,458 | 10/1964 | Short | 175/329 |
| 4,554,986 | 11/1985 | Jones | 175/329 X |
| 4,696,354 | 9/1987 | King et al. | 175/329 |
| 4,714,120 | 12/1987 | King | 175/329 |
| 4,719,979 | 1/1988 | Jones | 175/329 |
| 4,726,718 | 2/1988 | Meskin et al. | 175/329 X |

*Primary Examiner*—Stephen J. Novosad

*Attorney, Agent, or Firm*—Arnold, White & Durkee

[57] ABSTRACT

The subject drill bits include a body member with cutter blades having a generally parabolic bottom profile. The cutter blades each include a diamond cutting face which increases in vertical height generally as a function of increased distance from the center line of the bit. The increased height allows the bits to provide a desired total diamond cutting volume at each radius of the bit, while allowing the diamond contact area to remain generally constant as the bit wears.

20 Claims, 3 Drawing Sheets

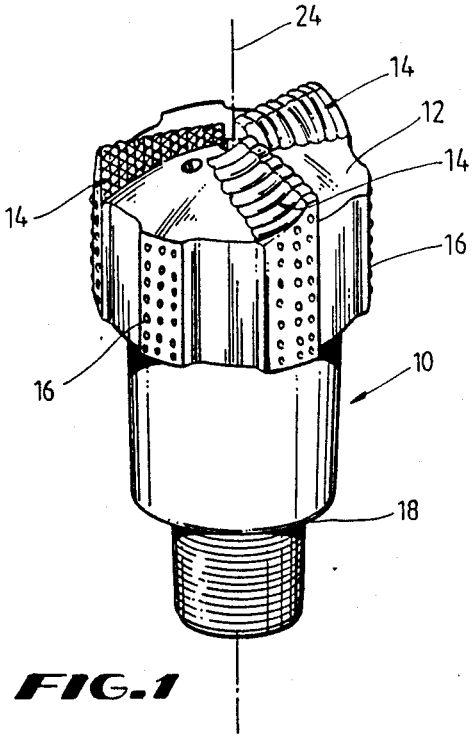
FIG.1
FIG.2
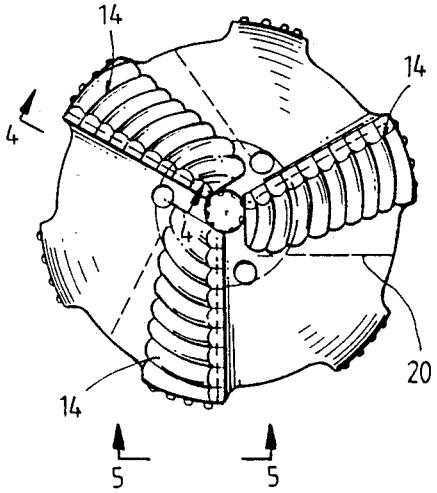
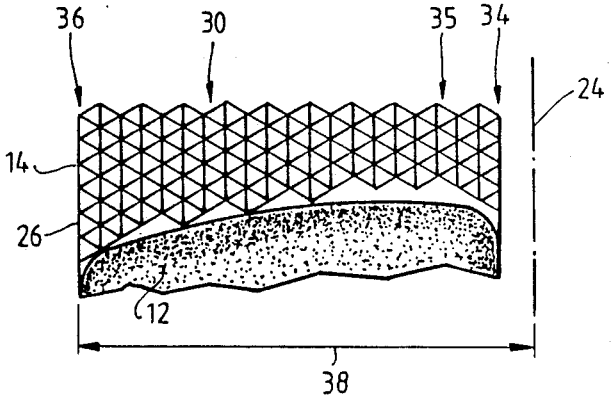
FIG.3
FIG.4
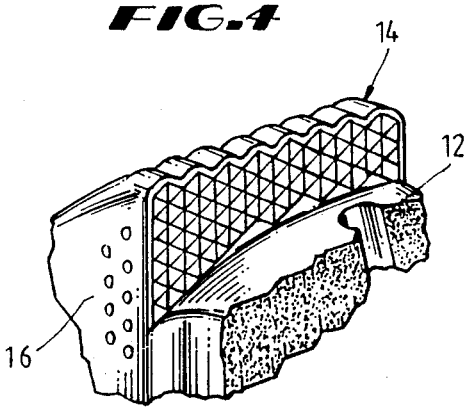

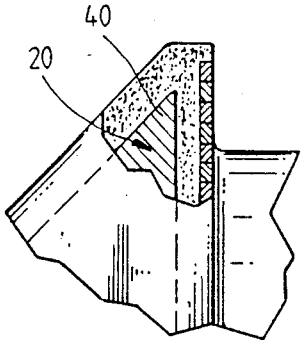
FIG.5
FIG.7
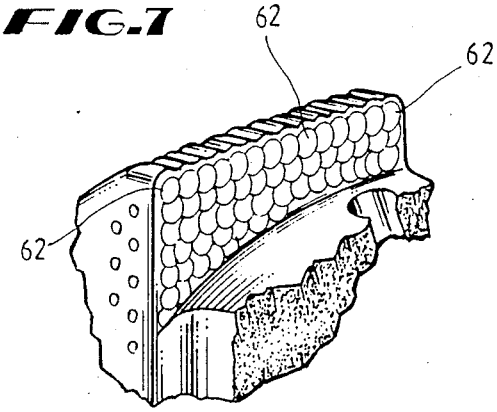
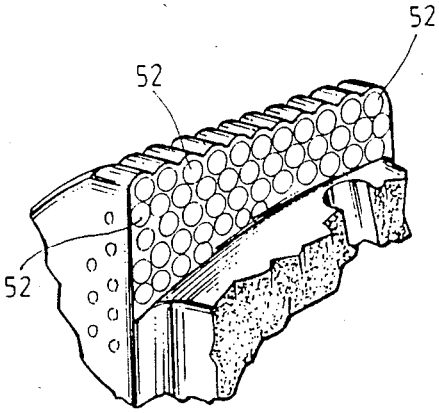
FIG.6
FIG.8
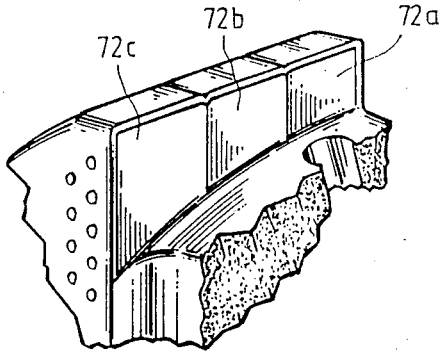
FIG.9
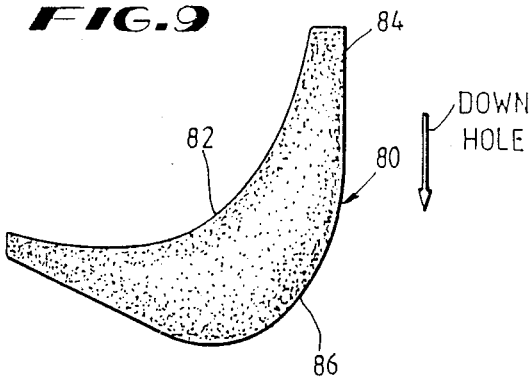

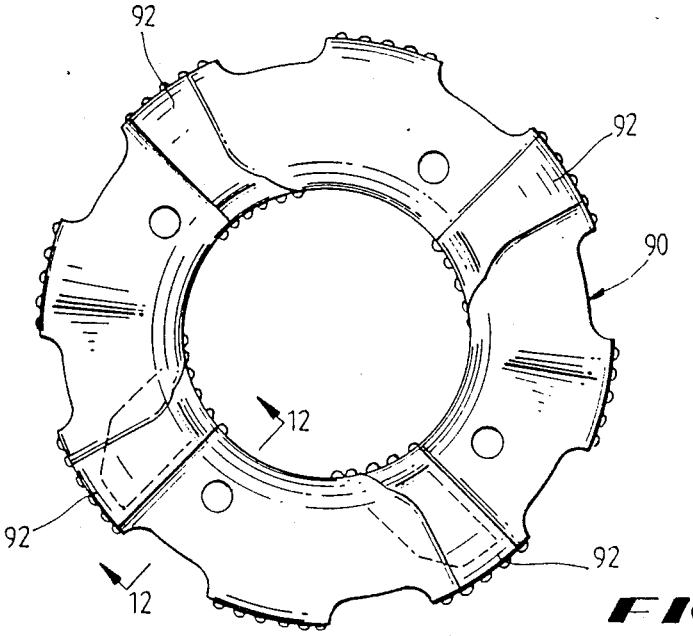
FIG.10
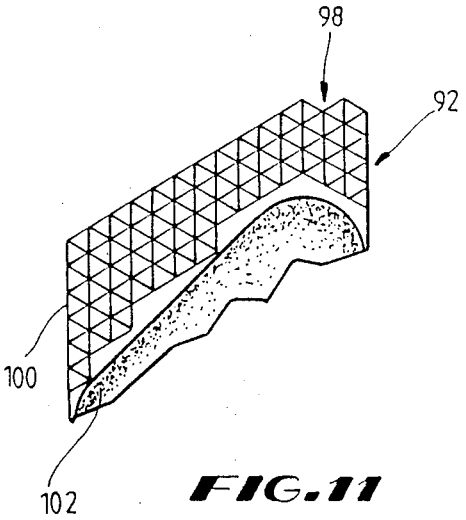
FIG.11
FIG.12
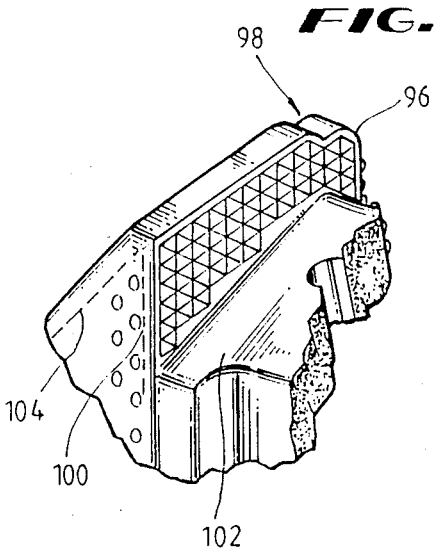

DRILL BIT HAVING IMPROVED CUTTER CONFIGURATION

BACKGROUND OF THE INVENTION

The present invention relates generally to drill bits, and more specifically relates to drill bits and methods for their construction which include an improved cutter configuration adapted to optimize the formation/cutter contact area while providing a desired volume of formation cutting material.

The use of drill bits for the drilling of wells in earth formations, or for taking cores of formations, is well known. Bits for either purpose may include either stationary cutting elements for cutting or abrading the earth formation, or cutting elements mounted on rotating cones. Bits as presently known to the industry which utilize stationary cutting elements typically use either natural or synthetic diamonds as cutting elements and are known as "diamond bits". References herein to "diamond bits" or "diamond drill bits" refer to all bits, for either drilling or coring, having primarily stationary cutters.

Conventional diamond drill bits include a solid body having a plurality of cutting elements, or "cutters," secured thereto. As the bit is rotated in the formation, the cutters contact and cut the formation. A flow of fluid is maintained through the bit to cool the cutters and to flush formation cuttings away from the cutters and into the annulus surrounding the drill string.

Conventional diamond drill bits may have a variety of different types of cutting surfaces, such as, for example, polycrystalline diamond compact (PDC) cutters, thermally stable diamond product (TSP) cutters, and mosaic-type cutters. Mosaic cutters are typically formed of a plurality of geometrically-shaped thermally stable diamond elements cooperatively arranged and retained in a desired shape, to form a unitary cutter.

With conventional diamond drill bits having such discrete cutters, the cutters are distributed on the bit to provide a desired volume of diamond for cutting the formation. The diamond volume will be determined partially in response to the amount of diamond which will provide adequate cutting of the formation, taking into consideration the wear of the cutters as the formation is cut. Additionally, as is well known, the cutters proximate the outer portion of the bit radius wear much more quickly because of the greater surface velocity as they encounter the formation. Accordingly, outer portions of the bit require much more diamond volume than do inner portions.

Conventional diamond drill bits having discrete cutters include individual cutters distributed across the face of the bit to establish the desired diamond volume. The cutters are distributed in greater numbers along outer portions of the bit radius, to provide greater diamond volume in such areas. Such conventional designs have inherent limitations, however. For example, the volume of diamond, and therefore the number of cutters, required to provide acceptable performance from the bit in terms of wear life, may require an undesirably high weight on bit to cause the bit to penetrate the formation. This is because a large number o cutters providing the diamond volume will also provide a large surface area in contact with the formation which resists penetration of the bit. Additionally, conventional bits, and particularly those with circular cutters, have surface contact areas which increase as the bit wears. For example, when an initial group of five one inch diameter cutters are initially contacting the formation, their curvilinear downward portions will only contact the formation across a chord (contact area), determined by the depth of cut, i.e., the depth to which each of the five cutters actually penetrates the formation. However, when these exemplary five cutters are half worn, their contact area is five full diameters of the cutters. With conventional bits, therefore, as the bit wears, the required weight on bit typically increases, while the rate of penetration typically decreases.

Bits have been proposed for use which have included cutting surfaces with increased depth toward the outer portions of the bit. However, these designs have achieved this increased depth through adjacent squares and rectangles of cutter facing, built up in steps forming large "fins" extending in stair-step blocks away from the body, forming a squared "fishtail" shape. An example of such a prior art bit is found in U.S. Pat. No. 3,059,708 issued Oct. 23, 1962, to Cannon et al. Such proposed designs have not been suitable for the use of different types of cutter facings. Additionally, the design produces a bit having a deep cone stepped profile, in clear contrast to favored generally flat or parabolic bit profiles. Such generally flat bits will be described herein as among those bits having "generally parabolic profiles." Thus, such "generally parabolic profiles," as used herein, may include bits having a generally flat, or slightly downwardly sloping (i.e., shallow-cone shaped) lower surface, as well as bits having upwardly sloping contours, such as, for example, generally "bullet-shaped" bits.

Accordingly, the present invention provides a new drill bit and method for constructing a drill bit wherein the total diamond volume may be varied independently of the diamond volume contacting the earth formation at a given time. Additionally, the diamond volume may be distributed along the radius of the bit to provide an optimal diamond volume at each point along the bit radius.

SUMMARY OF THE INVENTION

Drill bits may be constructed in accordance with the present invention which include a body member with cutter blades which have a generally parabolic bottom profile. The cutter blades will be constructed with a cutter face, preferably formed of diamond, which increases in vertical dimension generally as a function of increased distance from the centerline of the bit. In a particularly preferred embodiment, the cutting face will include a generally gradual flat or parabolic form, and the height of the cutting face will increase generally continually in response to increased distance from the centerline of the bit. The cutting face of the cutting blade may be formed of any desired type of diamond material, such as a PDC layer, a TSP layer, a composite mosaic surface, or an impregnated matrix filled with either PDC, TSP or natural diamond segments.

BRIEF DESCRIPTION OF THE DRAWINGS

FIG. 1 depicts an exemplary embodiment of a drill bit in accordance with the present invention, illustrated from a perspective view.

FIG. 2 depicts the drill bit of FIG. 1 from a lower plan view.

FIG. 3 schematically depicts a cutting blade of the drill bit of FIG. 1.

FIG. 4 depicts a cutting blade of the drill bit of FIG. 1 in perspective view.

FIG. 5 depicts the cutting blade of FIG. 4 illustrated from a side view and in vertical section.

FIG. 6 depicts an alternative embodiment of a cutter blade in accordance with the present invention.

FIG. 7 depicts an alternative embodiment of a cutter blade in accordance with the present invention.

FIG. 8 depicts an alternative embodiment of a cutter blade in accordance with the present invention.

FIG. 9 depicts an alternative configuration of a cutter blade suitable for use with drill bits in accordance with the present invention.

FIG. 10 depicts a drill bit adapted for coring a formation, in accordance with the present invention, illustrated from a bottom plan view.

FIG. 11 schematically depicts a cutting blade of the drill bit of FIG. 10.

FIG. 12 schematically depicts a cutter blade of the drill bit of FIG. 10 illustrated from a perspective view.

DETAILED DESCRIPTION OF PREFERRED EMBODIMENTS

Referring now to FIGS. 1–5, therein is depicted an exemplary embodiment of a drill bit 10 in accordance with the present invention. Drill bit 10 includes a body section 12 which includes cutting sections, indicated generally at 14, and gage pads, indicated generally at 16. Cutting sections 14 are each "blades" which may be formed from various diamond materials, as will be described in more detail later herein. Each of these blades 14 forms a single "cutter" of drill bit 10. Gage pads 16 may serve a cutting function, but normally would not unless extending radially beyond those portions of cutter blades 14 extending to the gage of drill bit 10.

Body 12 is preferably at least partially a molded component fabricated through conventional metal infiltration technology. Body 12 will preferably be formed of a tungsten carbide matrix. Body 12 is coupled to a shank 18 which includes a threaded portion adapted to couple to a drill string. Shank 18 and body 12 are preferably formed to be functionally integral with one another. Additionally, in this preferred embodiment, body 12 includes a steel form 20 coupled to shank 18, which generally follows the contours of body 12 proximate cutter 14. Drill bit 10 also includes an internal recess (not illustrated), through which hydraulic flow will pass.

In the depicted embodiment of drill bit 10, each cutter 14 extends from proximate the center line 24 of bit 10 to gage 26 of bit 10. Each cutter blade 14 is a mosaic cutter formed of a plurality of triangular-cross sectioned, thermally stable diamond product (TSP) elements bonded into the tungsten carbide matrix. Preferably, each TSP element will be coated to facilitate bonding of the material to the metal matrix of drill bit 10. An exemplary method and apparatus for coating TSP elements 28 is described in copending application Ser. No. 095,054, filed Sept. 15, 1987, in the names of Sung and Chen. The specification of application Ser. No. 095,054 is incorporated herein by reference for all purposes.

As can be seen from FIG. 3, each cutter blade 14 includes an initially generally flat profile across the surface of bit 10, indicated generally at 30. As can also be seen from FIG. 3, the vertical dimension, or height, of cutter blade 14 varies across the width of blade 14. Cutter blade 14 does not extend inwardly to centerline 24 of bit 10. A small core may be cut by blade 14 which will be broken by a core ejector during drilling. Because of anticipated increased wear proximate this core, the height of cutter blade 14 is increased at the innermost dimension 34 of blade 14, relative to an adjacent outer radial portion 35 of cutter blade 14. Similarly, with the exception of inner area establishing height 34, the height of cutter blade 14 generally increases in response to increased distance from centerline 24 of bit 10. The height 36 of cutter blade 14 proximate gage 26 of bit 10 is approximately 200% that of the shortest portions 35 of cutter blade 14.

The vertical dimension of cutter blade 14 is established in relation to the anticipated wear at each location along the bit radius 38. Cutter blade 14 is preferably formed of a single layer of TSP elements. Cutter blade 14 therefore has a generally uniform depth (or thickness), of approximately 0.106 inches (the nominal dimension of each TSP element 28), throughout its height.

As can be seen from a review of FIGS. 1–5, as bit 10 is rotated within a formation, even as wear to cutter blade 14 occurs, the volume of diamond per unit of length along bit radius 36 will remain generally constant. The only increase with respect to the volume of diamond contacting the formation which will occur is due to wear proximate primarily the outer half of the radius of bit 10 which establishes a radius on cutter blade 14, thereby effectively increasing the total length of cutter blade 14 between its innermost dimension and gage 26. The increasing of the vertical dimension of cutter blades 14 in an uphole direction facilitates both improved hydraulic cleaning of the cutter blades and improved flushing of the cuttings up the hole.

In FIG. 5, therein is depicted cutter blade 14 in vertical section. Steel form 20, discussed earlier herein, provides one means for optimizing the operation of drill bit 10. As noted earlier herein, steel form 20 preferably includes extensions 40 which extend into the matrix forming the rearward portion 42 of each blade, and which, in fact, form a substantial inner volume of such rearward portions. As bit 10 is operated in a formation, cutter blades 14 will gradually be worn down. The matrix forming the body of bit 10 is extremely hard and resistant to abrasion. If cutter blades 14 include solely a matrix backing behind the diamond cutting face, then as cutter blades 14 wear, the matrix may begin to form a standoff relative to the formation. However, where form 20 provides extensions 40 which form a substantial volume of the backup portions of each cutter blade 14, as each blade wears, the steel backing will gradually be exposed and will form an increasingly larger area of each exposed cutter blade backing. Because of the steel's relative abradability relative to the diamond (and to the matrix), the exposed steel backing provides only minimal resistance to the passage of each cutter blade 14 into the formation.

Referring now to FIG. 6, therein is depicted an alternative embodiment of a cutter blade 50 suitable for use with the present invention. Cutter blade 50, instead of being formed of a plurality of TSP segments of triangular cross-section, is formed of a plurality of generally cylindrical segments 52. Cylindrical segments 52 may be polycrystalline diamond compact (PDC) cutters, or may be cylindrical TSP segments. Cylindrical segments 52 will preferably be arranged as shown, in offset rows or horizons, in cutter blade 50, to provide maximum uniformity of diamond surface area at all horizons within cutter blade 50. Alternatively, different size cylinders may be arranged to form cutting blade 14. For example, large cylindrical segments as depicted could be arranged in aligned rows, with smaller cylindrical segments placed at intermediate horizons, in "voids" established between the larger cylindrical segments.

Referring now to FIG. 7, therein is depicted another alternative embodiment of a cutter blade 60 suitable for use with the present invention. Cutter blade 60 includes a plurality of cylindrical or partially cylindrical elements 62 which are cooperatively conformed and arranged to provide a generally uniform diamond volume per unit of surface length across cutter blade 60. Segments 62 are conformed with "scallops", where needed, to provide interlocking to cooperatively form cutter blade 60. Alternatively, segments 62 may include flats to facilitate their placement proximate one another. Such segments could then make use of used diamond cutters, which will often have flats worn in them naturally.

Referring now to FIG. 8, therein is depicted an alternative embodiment of a cutter blade 70 formed of PDC layers. Cutter blade 70 may be formed of one or more of such layers, depending upon the size of the cutter blade and the available PDC layers. In the depicted embodiment, cutter blade 70 is formed of three PDC layers *72a, 72b, 73c,* with each layer being partially rectangular, but with one angled surface increasing the total height of each layer *72a, 72b, 72c.*

Many configurations of cutter blades may be utilized in accordance with the present invention. A particular advantage of the present invention is that the blades may be conformed to provide optimal diamond distributions in various conformities of generally parabolic profile cutter blades. Referring now also to FIG. 9, therein is depicted an alternative embodiment of a cutter blade 80 believed to be generally representative of an embodiment having particular utility with the present invention. Cutter blade 80 has a generally parabolic profile with a height which increases generally continually from an inward portion of the blade to a gage cutting portion of the blade. The conformity may be considered as being defined by an upper surface 82 having a first general radius adapted to extend from the inner dimension to a point short of gage dimension 84, and by having a lower surface 86 of a radius smaller than the inner radius, but laterally displaced sufficiently to allow cooperative conforming of blade 80 with upper surface 82. As can be seen from FIG. 9, the height of cutter blade 80 reaches a maximum vertical dimension proximate gage dimension 84.

The depicted embodiment of cutter blade 80 is formed of an abrasive matrix material, but may be of any suitable diamond cutting material, such as, for example, those described and illustrated with respect to FIGS. 1–8. Preferably, the abrasive matrix material will be a diamond abrasive. Such a diamond abrasive matrix may be formed by placing diamond pieces in an abradable matrix. The matrix can be formed of the same tungsten carbide matrix used to form the body 12 of bit 10.

Referring now to FIGS. 10–12, therein is depicted a drill bit adapted for cutting cores (i.e., a "coring bit") 90, in accordance with the present invention. Coring bit 90 preferably includes four cutting blades 92 spaced at ninety degree intervals around body member 94 of bit 90. In the depicted embodiment, each cutting blade 92 is again a mosaic blade formed of a plurality of TSP segments 96. Cutting blades 92 again increase in height from a generally inner dimension 98, to exterior gage 100 of bit 90. As can be seen in FIG. 11, the increase in height is incremental across cutter blades 92. Additionally, the outer portion of each blade is above the inner portions (each figure depicts each bit in an inverted position, for clarity), providing an uphole slope on each cutter blade, facilitating improved hydraulic flow and removal of cuttings.

As with bit 10 of FIGS. 1–5, coring bit 90 again preferably includes a body 102 fabricated through metal matrix infiltration technology, and preferably includes a steel form member, partially illustrated at 104, which provides an extension behind each blade 92.

Many modifications and variations may be made in the techniques and structures and illustrated herein without departing from the spirit and scope of the present invention. For example, cutter blades may be formed of virtually any variety of geometric segments, including square and other shapes not particularly described or illustrated herein. Accordingly, it should be readily understood that the embodiments described and illustrated herein are illustrative only and are not to be considered as limitations upon the scope of the present invention.

I claim:

1. A drill bit comprising:

a body member; and at least one cutter blade on said body member, said cutter blade having a generally planar diamond cutting face extending from proximate the centerline of said bit generally outwardly, said cutting face having a generally continuous upper side and a generally continuous lower side, wherein the distance between said upper and lower sides of said cutting face increases generally continuously from the inner extent of said cutting face to the outer extent of said cutting face.

2. The drill bit of claim 1, wherein said cutter face of said cutter blade comprises a diamond material.

3. The drill bit of claim, 1 where said cutting blade extends from proximate the centerline of said bit to proximate the outer dimension of said bit.

4. The drill bit of claim 1, wherein said cutter blade extends generally across the radius of said bit.

5. The drill bit of claim 1, wherein said cutting face is formed of a diamond mosaic material.

6. The drill bit of claim 1, wherein said cutting face comprises a diamond impregnated matrix.

7. The drill bit of claim 1, wherein said cutting face comprises polycrystalline diamond compact material.

8. The drill bit of claim 1, wherein said lower side of said cutting face has a generally flat contour, and wherein said upper side of said cutting face has a generally curvilinear contour which extends upwardly and away from said lower side in response to increased distance from the center of said bit.

9. The drill bit of claim 1, wherein said lower side of said cutting face has a generally curvilinear contour, and wherein said upper side of said cutting face also has a generally curvilinear contour, and wherein the height of said cutting face at its outer extent relative to the center of said bit is greater than the height of said cutting face at its inner extent, relative to the center of said bit.

10. A drill bit, comprising:

a body member; and a plurality of cutter blades distributed on said body member, each cutter blade having a generally planar diamond cutting face, and having a height which increases generally continuously from the inner extent of said blade to the outer extent of said blade.

11. A drill bit, comprising:

a body member constructed at least partially of an abrasion-resistant matrix; and a plurality of cutter blades on said body member, at least one of said cutter blades having a generally planar diamond cutting face with a generally parabolic profile and extending generally across the radius of said bit, said parabolic profile established by upper and lower sides which diverge in relation to increased distance from the center of said body member.

12. The drill bit of claim 11, wherein said cutter blades comprise thermally stable diamond product material.

13. The drill bit of claim 12, wherein said thermally stable diamond material is established in a mosaic cutting face.

14. The drill bit of claim 13, wherein said cutting face comprises a diamond impregnated matrix material.

15. The drill bit of claim 13, wherein said cutting face comprises polycrystalline diamond compact material.

16. A method of constructing a drill bit, comprising:

establishing a body member; and establishing at least one cutter blade on said body member, said cutter blade having a generally planar diamond cutting face with a generally parabolic shape, said parabolic shape established by upper and lower sides which diverge in relation to increased distance from the center of said body member, said cutter blade established by providing a volume of diamond to form a cutting face of said blade, said volume established in varying quantities along the length of said blade generally in response to distance from the center of said bit.

17. The method of claim 16, wherein said volume of diamond is established at a generally uniform depth.

18. The method of claim 16, wherein said volume of diamond comprises diamond pieces arranged in a mosaic construction.

19. The method of claim 16, wherein said cutting face comprises polycrystalline diamond compact material.

20. The method of claim 16, wherein said volume of diamond comprises diamond impregnated matrix material.

* * * * *